US006481122B2

(12) United States Patent
Brahler

(10) Patent No.: US 6,481,122 B2
(45) Date of Patent: Nov. 19, 2002

(54) SHOE CLEAT APPARATUS

(76) Inventor: George R. Brahler, 4501 Broadmoor Dr., Lawrence, KS (US) 66046

( * ) Notice: Subject to any disclaimer, the term of this patent is extended or adjusted under 35 U.S.C. 154(b) by 0 days.

(21) Appl. No.: 09/849,954

(22) Filed: May 4, 2001

(65) Prior Publication Data

US 2002/0026731 A1 Mar. 7, 2002

Related U.S. Application Data

(63) Continuation-in-part of application No. 09/620,400, filed on Jul. 20, 2000, now abandoned.

(51) Int. Cl.[7] ..... A43C 15/02
(52) U.S. Cl. ..... 36/134; 36/67 R; 36/127
(58) Field of Search ..... 36/134, 67 R, 36/127, 61

(56) References Cited

U.S. PATENT DOCUMENTS 2,584,182 A * 2/1952 Bernstein
2,607,135 A * 8/1952 Langer
2,911,738 A * 11/1959 Clerke
3,195,246 A * 7/1965 Ueda
3,566,489 A * 3/1971 Morley
3,631,614 A * 1/1972 Rice
3,680,231 A * 8/1972 Dymond
3,977,097 A * 8/1976 Ueda
4,240,215 A * 12/1980 Broussard
4,255,877 A * 3/1981 Bowerman
4,262,434 A * 4/1981 Michelotti
4,470,207 A * 9/1984 Bente
4,587,748 A * 5/1986 Collins
5,337,494 A * 8/1994 Ricker
5,351,422 A * 10/1994 Fitzgerald
5,377,431 A * 1/1995 Walker et al.
5,655,317 A * 8/1997 Grant
5,938,384 A * 8/1999 Pratt

* cited by examiner

*Primary Examiner*—Ted Kavanaugh
(74) *Attorney, Agent, or Firm*—Hovey Williams LLP

(57) ABSTRACT

A shoe cleat apparatus is provided which includes a receiver and a spike which is configured for swiveling within the receiver. The receiver includes a barrel which has an interior space and a surrounding disc. A neck with a central opening is positioned below the barrel, the opening being smaller in transverse dimension than the interior space. A seat is provided below the neck. The spike includes a shank having a shaft, a tip, a collar positioned between the shaft and the tip, and an enlarged head. The shaft is sized to fit within the opening and the collar to fit within the seat. The head may be pushed through the opening of the receiver to retain the spike on the receiver. The head, shaft and collar are sized respective to the interior space, opening and seat to permit limited swiveling and thus tilting of the spike relative to the receiver.

16 Claims, 1 Drawing Sheet

SHOE CLEAT APPARATUS

This is a continuation-in-part of application Ser. No. 09/620,400 filed Jul. 20, 2000, now abandoned.

BACKGROUND OF THE INVENTION

1. Field of the Invention

The present application relates generally to anti-slipping devices configured for attachment to athletic shoes particularly shoes of the type worn in playing the game of golf. More particularly, the invention relates to an assembly including a detachable shoe cleat configured for attachment to the sole of a shoe and which is mounted for limited pivoting relative to the shoe sole.

2. Description of the Prior Art

Many athletic endeavors require the use of cleated shoes. In athletic sports such as baseball and golf, an athlete must wear cleated shoes to properly swing a bat or a golf club. Cleats having elongated spikes, however, are responsible for damage to playing surfaces such as a grass surface, and have been prohibited from wearing inside many clubhouses because of the damage inflicted on floors and carpets. For example, when swinging a bat or a golf club, the athlete's feet often twist on the playing surface. During such twisting action, the spikes on the shoe of the athlete, which are implanted in the surface, carve and tear through the surface, creating damaging gouges, tears and rips in the grass surface or, even less desirably, damaging the carpet or flooring.

Damage is also caused to playing surfaces when an athlete changes direction while walking or beginning to walk. For example, when putting, a golfer faces approximately 90 degrees away from the intended target, the hole in the green, when putting toward the hole. After completing a putt, the golfer must turn 90 degrees to walk toward the hole. Commonly, golfers twist while turning and lifting their feet, causing the spikes on their shoes to carve into the surface of the green, resulting in considerable cumulative damage when it is remembered that several golfers will walk on a green in a relatively short period of time.

Another form of damage to a playing surface is caused by simply walking across the playing surface. For example, athletes occasionally drag their feet when walking. This action causes the spikes on their shoes to scrape the surface, resulting in a tearing of the playing surface.

Damage caused by spiked shoes has prompted many golf courses to encourage or even mandate golfers to seek alternatives, especially when walking on greens, which are extremely expensive and easily damaged. One known alternative is to have shoes with spikeless cleats. When wearing spikeless shoes, the twisting action of the wearer does not tend to carve into the playing surface as would be the case if the wearer were not using spiked shoes. Spikeless cleats, however, do not provide sufficient traction to adequately prevent the golf shoes from slipping on the playing surface during the action of a golf swing.

It is also known to provide a rotatable plate having a plurality of spikes, which plate is mounted on the on bottom of the sole of a golf shoe and is configured to rotate about a vertical axis, allowing the spike to remain relatively stationary with respect to the playing surface while the golf shoe itself twists relative to the playing surface. The rotatable plate device, therefore, reduces the damage to playing surfaces caused by twisting feet. However, if the wearer pivots about one of several such spikes on the bottom of the shoe, others will necessarily drag and tear the surface because only rotational motion is permitted for each spike. Moreover, this device is relatively large and complex and does not address the problem associated with the dragging of a wearer's shoes across a playing surface during a game of golf.

SUMMARY OF THE INVENTION

It is the object of the present invention to provide a detachable shoe cleat apparatus which is configured to be attached to the sole of a shoe, such as a golf shoe, and which apparatus inhibits slippage of the shoe across a playing surface, such as a grass surface, and which minimizes damage caused to the surface by the cleat apparatus.

It is another object of the invention to provide a shoe cleat apparatus configured to minimize the size of spike marks formed in the playing surface by the cleat apparatus.

It is a further object of the invention to provide a shoe cleat apparatus which functions in such a manner as to inhibit the scraping of the playing surface by the cleat apparatus as the wearer moves with respect to the playing surface.

It is an additional object of the invention to provide a shoe cleat apparatus which facilitates mounting of replaceable spikes.

It is another object of the invention to provide a shoe cleat apparatus which is complementally configured as a replacement for conventional golf spikes and mounts in existing golf cleat receivers.

It is another object of the invention to provide a shoe cleat apparatus whereby multiple cleats can be mounted to a sole of a shoe whereby each spike engaging a surface is capable of independent swiveling relative to the other spikes.

It is yet another object of the invention to provide an economical spike which may be made of either metal or synthetic resin and provide satisfactory traction.

These and other objects are largely met by the shoe cleat apparatus of the present invention which minimizes the size of spike marks in a playing surface, is easy to install and, even more importantly, inhibits scraping, tearing or ripping of the surface as a result of the wearer of the shoe cleat apparatus walking across a surface such as, for example, a golf green while still providing improved traction.

The shoe cleat apparatus hereof broadly includes a body which functions as a receptacle for a spike which is mounted for limited swiveling movement therein. The body defines an interior space and has a column which is preferably externally threaded for inserting into a conventional golf shoe spike receiver. The spike includes a shank which has a portion thereof carried within the body, that portion mounting an enlarged head which inhibits undesired dislodgement of the spike from the receiver but permits the spike to be inserted and removed without removal of the receiver from the shoe. The spike is configured and positioned for swinging and rotating movement relative to the receiver, i.e., swiveling, from a neutral position where the longitudinal axis of the elongated spike is aligned and coincident with the longitudinal axis of the interior space of the body to an articulated position where the longitudinal axis of the spike is angled relative to the longitudinal axis of the body. The tip of the spike protrudes from the receptacle and is prevented from receding into the interior space by a collar on the spike which enables the swiveling movement while providing a base which promotes positioning of the spike in a stable, upright position.

The foregoing is accomplished by providing the spike, which has a proximate end and a distal end, with a collar which is engaged by the body, and an enlarged head which is sized and configured to be forced past a neck in the body. The collar having a surface which mates and engages with a seat of the body. The body includes a barrel defining therein the interior space and is preferably externally threaded for screwing into a complementally threaded receptacle in the sole of the shoe. Both the collar and the body around the seat are preferably circular, the diameter of the collar being somewhat smaller than the diameter of the seat to permit limited swiveling of the spike relative to the receiver. Swiveling, as used herein, includes both rotation around the longitudinal axis of the receiver body and tilting along two axes but not up and down translational movement.

Swiveling of the spike with respect to the receiver is further enabled by the sizing of the head and the interior space. The interior space has a somewhat greater transverse dimension or diameter than the transverse dimension or diameter of the head, such that the spike is able to swing and swivel within the barrel of the receiver. Thus, when a moment is applied to the distal end of the spike, the spike is able to swivel and thus swing to a limited degree by the ability of the head at the proximate end to move laterally within the interior space of the barrel of the receiver. On the other hand, when a golfer is standing still, the collar of the spike helps to maintain a stable position by flat engagement with the seat.

The shoe cleat apparatus is configured for removable attachment to the sole of a shoe such as a golf shoe. To this end, the externally threaded barrel of the receiver may be easily screwed into a receptacle complementally configured with internal threads, the receptacle being permanently mounted in the sole as is conventional. The spike may be replaced within the receiver because the head is sized and configured to be forced through the neck of the receiver and removed by pulling therethrough in the same manner. Preferably, the head is slotted to provide two ears which are yieldable when compressed and then, after passing through the narrowed neck, spring back to the original expanded position. The receiver and the spike may be made of metal or of synthetic resin.

By wearing shoes equipped with the shoe cleat apparatus hereof, the tips of the spikes, when embedded in the playing surface, remain relatively stationary with respect to the surface on which the golfer is standing during swinging. As the golfer rotates his or her hips during the swing, one or both feet may shift or pivot. The spikes embedded in the playing surface retain their position, while those on the moving foot may swivel and tilt. When the golfer's feet lift to walk across the playing surface, such as a golf green, the distal end of the spike is permitted to swivel when engaged by the green, which prevents the spike from digging into the green and causing damage thereto during movement of the golfer across the green.

These and other advantages of the golf cleat apparatus hereof will be readily apparent to those skilled in the art with respect to the drawing and description which follows.

DESCRIPTION OF THE PREFERRED EMBODIMENTS

Figure 1:
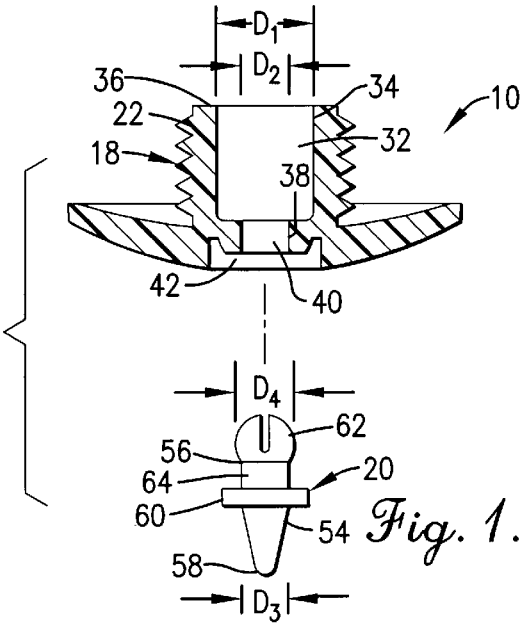
FIG. 1 is a exploded view of the golf cleat apparatus hereof, showing the receiver in vertical section and the spike in elevation.

Referring now to the drawing, a shoe cleat apparatus 10 in accordance with the present invention is shown in FIGS. 1 through 7 and is designed for use on a shoe 12 having a sole 14 which mounts therein a receptacle 16 which is typically bonded or otherwise secured to the sole 14. The receptacle 16 is internally threaded and is typically of metal such as stainless steel or synthetic resin for rust resistance. It is to be understood that a shoe will typically have multiple receptacles 16 spaced apart and arranged on the sole 14 in a desired pattern, into each of which a corresponding shoe cleat apparatus 10 hereof may be installed. The shoe cleat apparatus 10 broadly includes a body or receiver 18 and a spike 20.

In greater detail, the receiver 18 has a barrel 22 having a longitudinal axis A and an enlarged disc 24 having a dome-shaped convex bottom surface with two opposed depressions or holes 26 and 28 therein sized and positioned to receive the tines of a cleat tool. Such a tool is well known for use during insertion and removal of conventional golf cleats, and is used here to screw the receiver 18 into its corresponding receptacle 16. When the receiver 18 is screwed into the receptacle 16, the disc 24 serves to spread the weight of the wearer across a greater area of the sole as is typical in conventional golf spikes. The barrel 22 has external threads 30 thereon and presents an interior space 32 having a transverse dimension $D_1$. The interior space 32 is preferably cylindrical in configuration, $D_1$ thus being a diameter, and the barrel 22 thus preferably having a smooth cylindrical wall 34 which is open at its top end 36. A narrowed neck 38 is located at the bottom end of the barrel 22 and presents an opening 40 having a transverse dimension $D_2$ which is smaller than $D_1$ and is also preferably a diameter, the opening 40 being circular. A seat 42 is provided in the receiver below the neck 38. The bottom margin 44 of the neck 38 is preferably flat and substantially normal to the interior wall 46 of the neck 38 defining opening 40. The bottom margin 44 lies adjacent upwardly extending outer wall 48. A downwardly extending inner surface 50 is opposite the interior wall 46 and spaced radially outwardly therefrom, presenting an annular recess 52 therebetween. The seat 42 is centered on the longitudinal axis A of the barrel 22 and on the disc 24.

Figure 3:
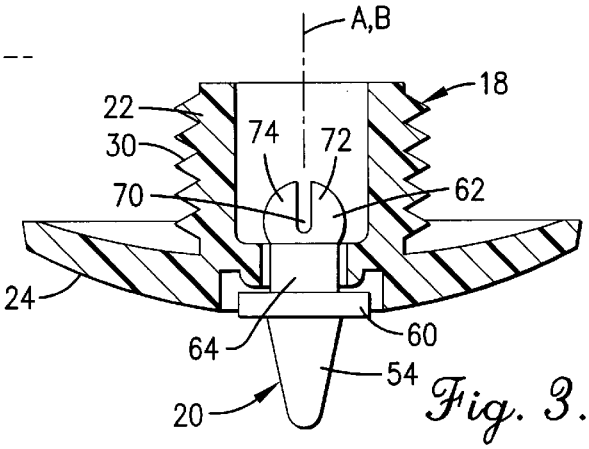
FIG. 3 is an enlarged view showing the head of the spike positioned within the barrel of the receiver, the longitudinal axis of the spike being coincident with the longitudinal axis of the receiver when the golfer is in a standing position.
Figure 6:
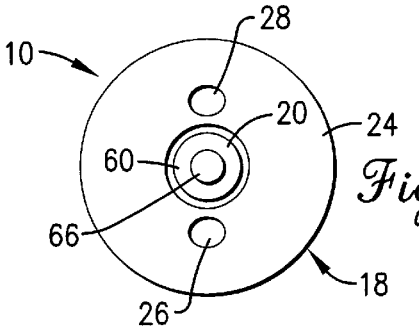
FIG. 6 is a bottom view of the golf cleat apparatus hereof.
Figure 7:
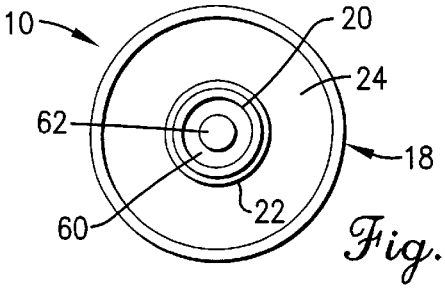
FIG. 7 is a top plan view thereof.
Figure 4:
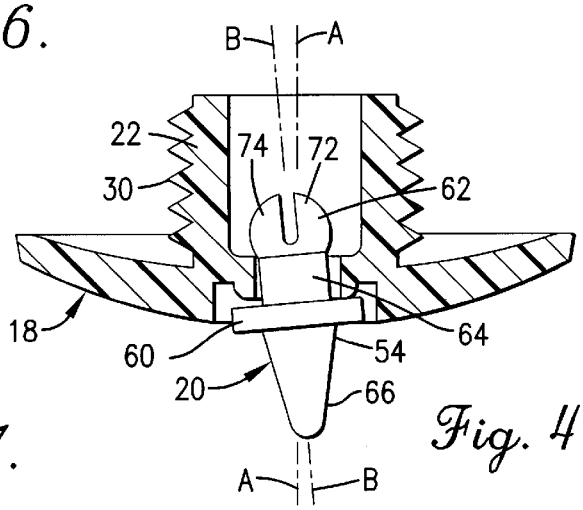
FIG. 4 is an enlarged view similar to FIG. 3 but wherein the tip of the spike is subjected to a moment, causing the longitudinal axis of the spike to be angled relative to the longitudinal axis of the receiver.

The spike 20 includes a shank 54 having a proximate end 56 and a distal end 58, a collar 60 mounted on the shank 54 intermediate its proximate end 56 and distal end 58, and an enlarged head 62 mounted on the proximate end 56 of the shank. The longitudinal axis B of the spike 20 extends along the elongated shank 54. The shank 54 includes a shaft 64 which is cylindrical but may also be conical or have a polygonal outer surface, the shaft 64 being located between the collar 60 and the head 62, and a tip 66 positioned between the collar 60 and the distal end 58, the tip 66 being preferably conical although other configurations could be employed. The collar 60 is preferably has a flat upper surface 68 for engagement with the bottom margin 44 of the neck 38. The shaft 64 has a transverse dimension $D_3$ which is preferably a diameter, the dimension $D_3$ being sufficiently less than $D_2$ and the axial length of the shaft 64 between the collar 60 and the head 62 being sufficiently greater than the axial length of the neck 38 to permit swiveling and thus tilting of the shaft 64 within the opening 40 as shown in FIG. 4. The collar 60 is preferably circular and has a transverse dimension $D_5$ which is a diameter and is greater than $D_3$ and $D_2$ to prevent passage of the collar 60 through the opening 40 but small enough to fit within the seat 42 as shown in FIGS. 3 and 4 and to permit swiveling of the spike 20.

Figure 2:
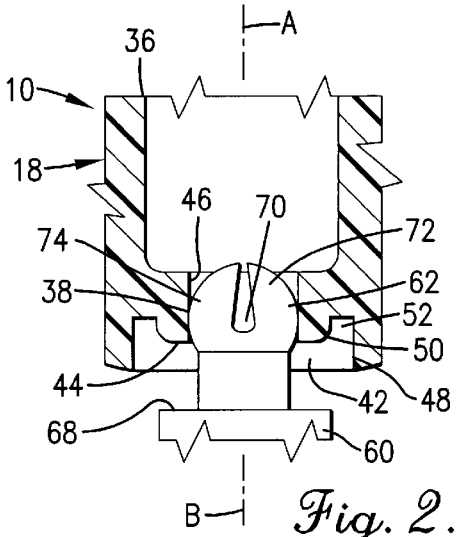
FIG. 2 is an enlarged fragmentary view of the golf cleat apparatus of FIG. 1, showing the head on the proximate end of the spike as it passes through the neck of the receiver.
Figure 5:
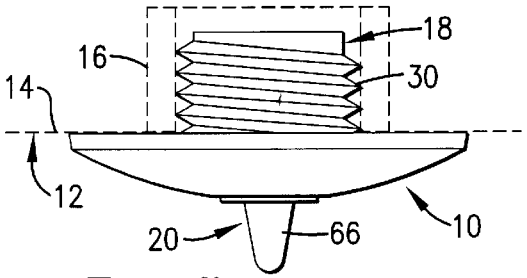
FIG. 5 is a vertical elevational view of the golf cleat apparatus in a shoe, showing in vertical section a fragment of the sole of the shoe and the receptacle into which the receiver is screwed.

The head 62 is preferably substantially spherical in shape and positioned on the proximal end of the shank 54. The head thus has a transverse dimension $D_4$ which is greater than $D_3$ or $D_2$ but less than $D_1$ in order to permit the head 62 to be received in the interior space 32 and to permit swiveling and thus tilting of the spike 20 relative to the receiver 18. The head 62 is also thus slightly larger than the opening 40 so that it may be forced past the neck during insertion of the spike 20 into the receiver 18, but be retained against undesired dislodgement. To facilitate insertion and removal of the spike 20, the head 62 may be provided with one or a plurality of slots 70 which thereby provides two ears 72 and 74 which are yieldable to compress upon engagement of the head with the neck as shown in FIG. 2. The ears 72 and 74 are resilient such that upon passage of the head 62 past the neck 38 and into the interior space 32, the ears 72 and 74 return to their original position as shown in FIG. 3.

In use, the receiver 18 is first screwed into its receptacle 16 using a conventional cleat tool whose tines are received in the holes 26 and 28. As discussed above, a plurality of receptacles are typically provided in the sole of a shoe, and thus several such receivers 18 are installed. The spike 20 is easily inserted into each of the receivers by simply forcing the head 62 through the opening 40 and past the neck 38 so that the head 62 is received within the interior space. The spike 20 may be provided of a softer material than the receiver 18 so that during use, the spike 20 wears rather than the receiver 18. As the tip or collar of the spike 20 wears during use, the spike 20 may be replaced by pulling the spike 20 downwardly through the opening 40.

When the wearer plants his or her shoe 12 on a surface, the tip 66 penetrates into the surface to provide improved traction. When the wearer stands, the flat upper surface 68 of the collar 60 engages with the flat bottom margin 44 of the neck 38 and the weight of the wearer tends to cause these two flat surfaces to mate, thereby providing a stable platform. However, the spike 20 is free to swivel to a limited degree within the receiver 18, such that as the shoe 12 shifts, turns or drags across the surface, the longitudinal axis B of the spike may tilt and become angled relative to the longitudinal axis A of the receiver, thereby reducing damage to the green or other surface.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. A shoe cleat apparatus configured for mounting to a sole of a shoe, said apparatus comprising:

a body including a barrel defining an interior space having a first transverse dimension and a neck presenting an opening communicating with the interior space and having a second transverse dimension smaller than said first transverse dimension;

a spike including an elongated shank having a proximal end and a distal end, a portion of the shank proximate the proximal end being swingably received in the interior space;

a collar on the shank positioned intermediate the proximal and distal ends, the collar having a third transverse dimension greater than the first transverse dimension and the second transverse dimension to prevent passage through the opening and into the interior space; and a head on the proximal end of the shank having a fourth transverse dimension larger than the second transverse dimension of the opening but smaller than the first transverse dimension of the interior space.

2. The shoe cleat apparatus of claim 1, wherein the body includes a seat below the barrel sized to receive the collar therein and to permit limited shifting of the collar within the seat.

3. The shoe cleat apparatus of claim 2, wherein the seat includes an annular recess radially outward of the neck.

4. The shoe cleat apparatus of claim 1, wherein the body includes a disc extending radially outwardly from the barrel.

5. The shoe cleat apparatus of claim 4, wherein the disc includes at least one hole therein positioned radially outwardly from the opening.

6. The shoe cleat apparatus of claim 1, wherein a portion of the shank longitudinally opposite the head includes a conical tip.

7. The shoe cleat apparatus of claim 1, wherein the head includes a slot therein.

8. The shoe cleat apparatus of claim 1, wherein the spike is of metal.

9. The shoe cleat apparatus of claim 1, wherein the spike is of synthetic resin.

10. A shoe cleat apparatus configured for mounting to a sole of a shoe, said apparatus comprising:

a receiver configured for mounting to the sole; and a spike including a shaft swingably received in said receiver for swiveling relative thereto, a tip, and an enlarged collar positioned intermediate the tip and the shaft positioned for engaging the receiver and sized for preventing passage of the tip into the receiver while permitting said swiveling of said shaft.

11. A shoe cleat apparatus configured for mounting to a sole of a shoe, said apparatus comprising:

a receiver configured for mounting to the sole; and a spike including a shaft configured for receipt in said receiver and swiveling relative thereto, a tip, and an enlarged collar positioned intermediate the tip and the shaft positioned for engaging the receiver and sized for preventing passage of the tip into the receiver while permitting said swiveling of said shaft, wherein the receiver includes a barrel and a disc extending radially from the barrel, the barrel defining therein an interior space receiving a portion of the shaft therein.

12. The shoe cleat apparatus of claim 11, wherein the receiver includes a neck positioned below the barrel, the neck having an opening therein sized for receiving the shaft but not the collar therein.

13. The shoe cleat apparatus of claim 12, wherein the receiver includes a seat below the neck sized for receiving the collar therein.

14. The shoe cleat apparatus of claim 13, wherein the spike includes a head positioned on the shaft and sized for receipt in the interior space of the barrel but greater than the opening.

15. The shoe cleat apparatus of claim 14, wherein the head includes a slot for facilitating pushing of the head through the opening.

16. The shoe cleat apparatus of claim 15, wherein the shaft has a longitudinal length greater than the longitudinal length of the neck.

* * * * *